US007324768B2

(12) United States Patent
Ravitz et al.

(10) Patent No.: US 7,324,768 B2
(45) Date of Patent: Jan. 29, 2008

(54) METHOD AND DEVICE FOR DETERMINING ONE OR MORE OPERATING POINTS IN AN IMAGE FORMING DEVICE

(75) Inventors: Cary Patterson Ravitz, Lexington, KY (US); Gary Scott Overall, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 314 days.

(21) Appl. No.: 11/239,587

(22) Filed: Sep. 29, 2005

(65) Prior Publication Data

US 2007/0071470 A1 Mar. 29, 2007

(51) Int. Cl.
*G03G 15/00* (2006.01)

(52) U.S. Cl. ..... 399/49; 399/51; 399/53

(58) Field of Classification Search ..... 399/9, 399/38, 46, 49, 51, 53, 54, 55, 56
See application file for complete search history.

(56) References Cited

U.S. PATENT DOCUMENTS

| | | | |
|---|---|---|---|
| 4,377,338 | A | 3/1983 | Ernst |
| 4,893,179 | A | 1/1990 | Ito |
| 4,894,685 | A | 1/1990 | Shoji |
| 5,103,260 | A | 4/1992 | Tompkins et al. |
| 5,121,196 | A | 6/1992 | Hung |
| 5,153,576 | A | 10/1992 | Harrington |
| 5,200,783 | A | 4/1993 | Maeda et al. |
| 5,237,517 | A | 8/1993 | Harrington et al. |
| 5,293,207 | A | 3/1994 | Haneda |
| 5,327,209 | A | 7/1994 | Sasanuma et al. |
| 5,355,440 | A | 10/1994 | Sayanagi et al. |
| 5,359,436 | A | 10/1994 | Dichter et al. |
| 5,369,476 | A | 11/1994 | Bowers et al. |
| 5,493,321 | A | 2/1996 | Zwadlo |
| 5,528,386 | A | 6/1996 | Rolleston et al. |
| 5,710,824 | A | 1/1998 | Mongeon |
| 5,713,062 | A | 1/1998 | Goodman et al. |
| 5,764,795 | A | 6/1998 | Takeo et al. |
| 5,781,206 | A | 7/1998 | Edge |
| 5,897,239 | A | 4/1999 | Caruthers, Jr. et al. |
| 5,909,235 | A | 6/1999 | Folkins |
| 5,995,774 | A | 11/1999 | Applegate et al. |
| 6,070,022 | A | 5/2000 | Kobayashi et al. |
| 6,137,596 | A | 10/2000 | Decker et al. |
| 6,181,892 | B1 | 1/2001 | Fujimori |
| 6,215,562 | B1 | 4/2001 | Michel et al. |
| 6,223,007 | B1 | 4/2001 | Kitagawa et al. |
| 6,252,580 | B1 | 6/2001 | Harrington |
| 6,377,763 | B2 | 4/2002 | Sato |
| 6,450,606 | B1 | 9/2002 | Kato et al. |
| 6,463,227 | B1 | 10/2002 | Denton et al. |
| 6,529,616 | B1 | 3/2003 | Rasmussen et al. |
| 6,556,793 | B2 | 4/2003 | Nakamura |

(Continued)

*Primary Examiner*—Hoan Tran
(74) *Attorney, Agent, or Firm*—Coats & Bennett, P.L.L.C.

(57) ABSTRACT

Methods and devices for setting an operating point within an image forming device. The operating point for one or more image forming stations may be determined without performing a toner patch sensing procedure. The operating points are determined based on other information, such as the operating points of one or more other image forming stations, information about the device, and information about the image forming stations themselves. The different factors may be weighted to more accurately determine the operating parameter(s).

20 Claims, 3 Drawing Sheets

U.S. PATENT DOCUMENTS 6,560,418 B2 5/2003 Campbell et al.
6,731,889 B2 5/2004 Nakayama
6,778,300 B1 8/2004 Kohler
6,806,979 B2 10/2004 Fukasawa
6,836,625 B2 12/2004 Shiratori
6,847,791 B2 1/2005 Kitagawa et al.
6,853,815 B2 2/2005 Tezuka et al.
7,006,250 B2 * 2/2006 Denton et al. ..... 358/1.9
7,203,431 B2 * 4/2007 Shoji et al. ..... 399/9

* cited by examiner

METHOD AND DEVICE FOR DETERMINING ONE OR MORE OPERATING POINTS IN AN IMAGE FORMING DEVICE

BACKGROUND

An image forming device forms images by transferring toner to a media sheet. The toner is initially stored within an image forming station and then transferred through a series of steps to ultimately be transferred to the media sheet. This process requires that one or more different operating parameters be set to allow the toner to move from the image forming station and ultimately reach the media sheet.

For a color image forming device, multiple image forming stations are included that each contain a different color toner. Each color toner is transferred from their respective image forming stations independently of the other color toners. At some point in the process, the different color toners are combined together to form the overall color image.

Different operating parameters may be used to transfer the different color toners. By way of example, a first set of parameters is used to transfer black toner to the media sheet, and a second set of parameters is used to transfer yellow toner. These parameters are set to ensure a proper amount of each toner is transferred to the media sheet. In the event not enough toner is transferred, the toner image on the media sheet may be too light relative to the other colors and result in a print defect. Likewise, too much transferred toner may cause the image to be too dark relative to the other colors.

Prior art devices determine the operating parameters by a toner patch sensing procedure. This procedure includes transferring a toner image for each color from the respective image forming station under a set of predetermined operating parameters. A sensor within the device then detects the transferred toner to monitor the toner density of unfused images and provide a means of controlling the print darkness. This information is then used to adjust laser power, photoconductor charge, developer bias, and other process conditions that affect image density. The toner patch sensing procedure is also used to maintain the color balance and in some cases to modify the gamma correction or halftone linearization as the electrophotographic process changes with the environment and aging effects.

A drawback of the prior art devices is the toner patch sensing procedure takes time to form each test toner image and sense the image. The testing procedure may reduce overall throughput of the device, particularly for the first sheet of a print job when the testing procedure is more likely to occur. Further, the test toner is discarded prior to actual image formation of the print job. This causes additional waste toner, and also requires that the waste toner be accommodated or somehow discarded.

Another drawback of toner patch sensing is the inability to accurately detect a black toner patch on a dark surface. This may occur if the black toner patch is placed on a black belt. Cyan, magenta, and yellow toners are each fairly reflective and can be accurately detected. However, the black toner does not have the same reflectivity which may prevent an accurate detection.

SUMMARY

The present application is directed to methods and devices for setting one or more operating parameters within an image forming device. The operating parameters for a particular image forming station are set based on one or more factors from the image forming device, other image forming stations within the device, and/or the particular image forming station itself. These factors may further be weighted to more accurately determine the operating parameters.

DETAILED DESCRIPTION

The present application is directed to methods and devices for setting the operating points within an image forming device. The operating point for one or more image forming stations is determined without performing a toner patch sensing procedure, or with additional information than just the toner patch sensing procedure. The operating points are determined based on other information, such as the operating points of one or more other image forming stations, information about the device, and information about the image forming stations themselves. The different factors may be weighted to more accurately determine the operating parameter(s).

Figure 1:
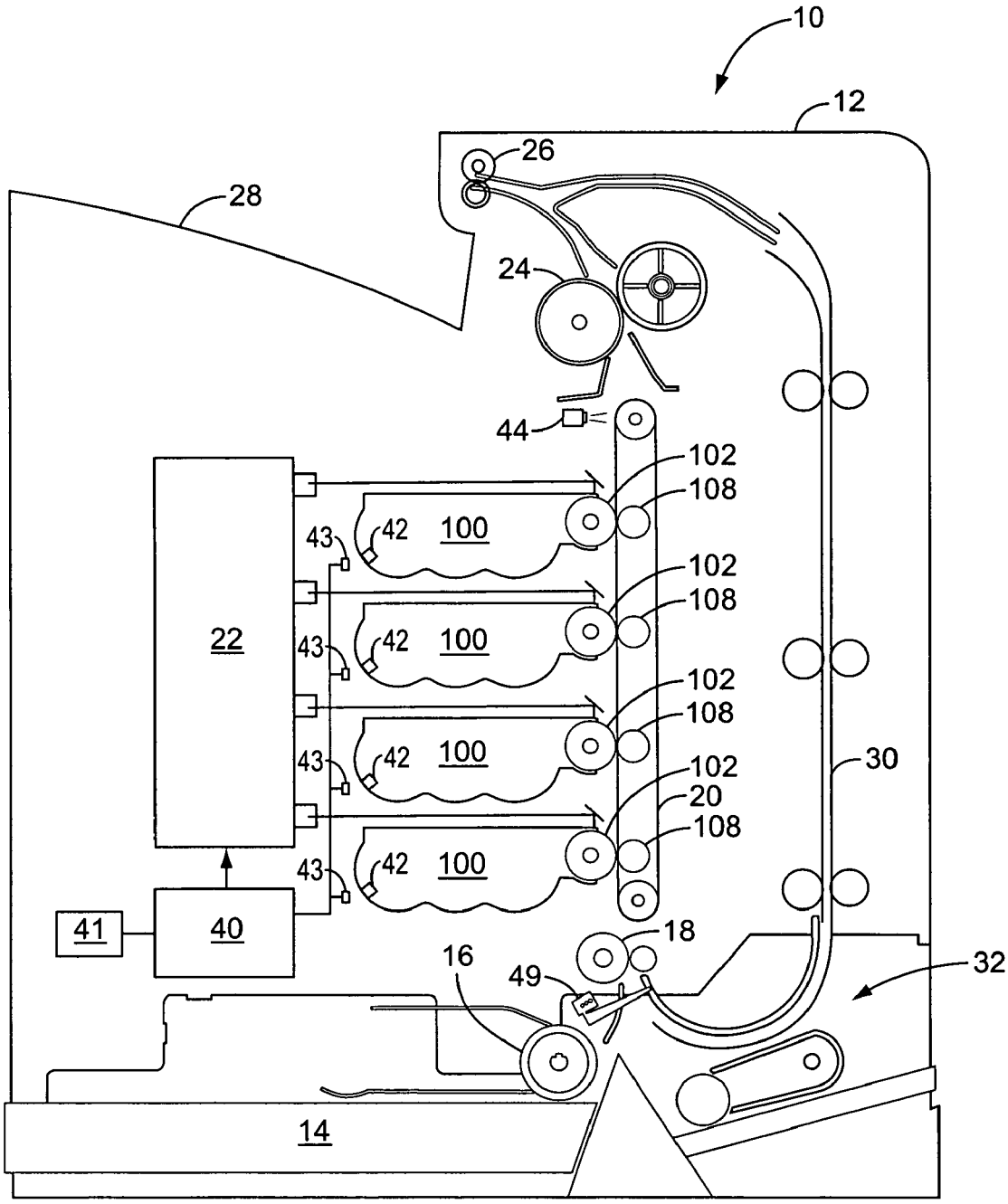
FIG. 1 is a schematic diagram of an image forming device according to one embodiment of the present invention.

FIG. 1 depicts a representative image forming device, such as a printer, indicated generally by the numeral 10. The image forming device 10 comprises a main body 12, at least one media tray 14, a pick mechanism 16, registration roller 18, a media transport belt 20, a printhead 22, a plurality of image forming stations 100, a fuser roller 24, exit rollers 26, an output tray 28, and a duplex path 30. The media tray 14, disposed in a lower portion of the main body 12, contains a stack of print media on which images are to be formed. The media tray 14 is preferably removable for refilling. Pick mechanism 16 picks a media sheet from the top of the media stack in the media tray 14 and feeds the print media into a primary media path. Registration roller 18, disposed along a media path, aligns the print media and precisely controls its further movement along the media path.

Media transport belt 20 transports the print media along the media path past a series of image forming stations 100, which apply toner images to the print media. Color printers typically include four image forming stations 100 for printing with cyan, magenta, yellow, and black toner to produce a four-color image on the media sheet. The media transport belt 20 conveys the print media with the color image thereon to the fuser roller 24, which fixes the color image on the print media. Exit rollers 26 either eject the print media to the output tray 28, or direct it into a duplex path 30 for printing on a second side of the print media. In the latter case, the exit rollers 26 partially eject the print media and then reverse direction to invert the print media and direct it into the duplex path. A series of rollers in the duplex path 30 return the inverted print media to the primary media path for printing on the second side. The image forming device 10 may further include an auxiliary feed 32 to manually feed media sheets.

Figure 2:
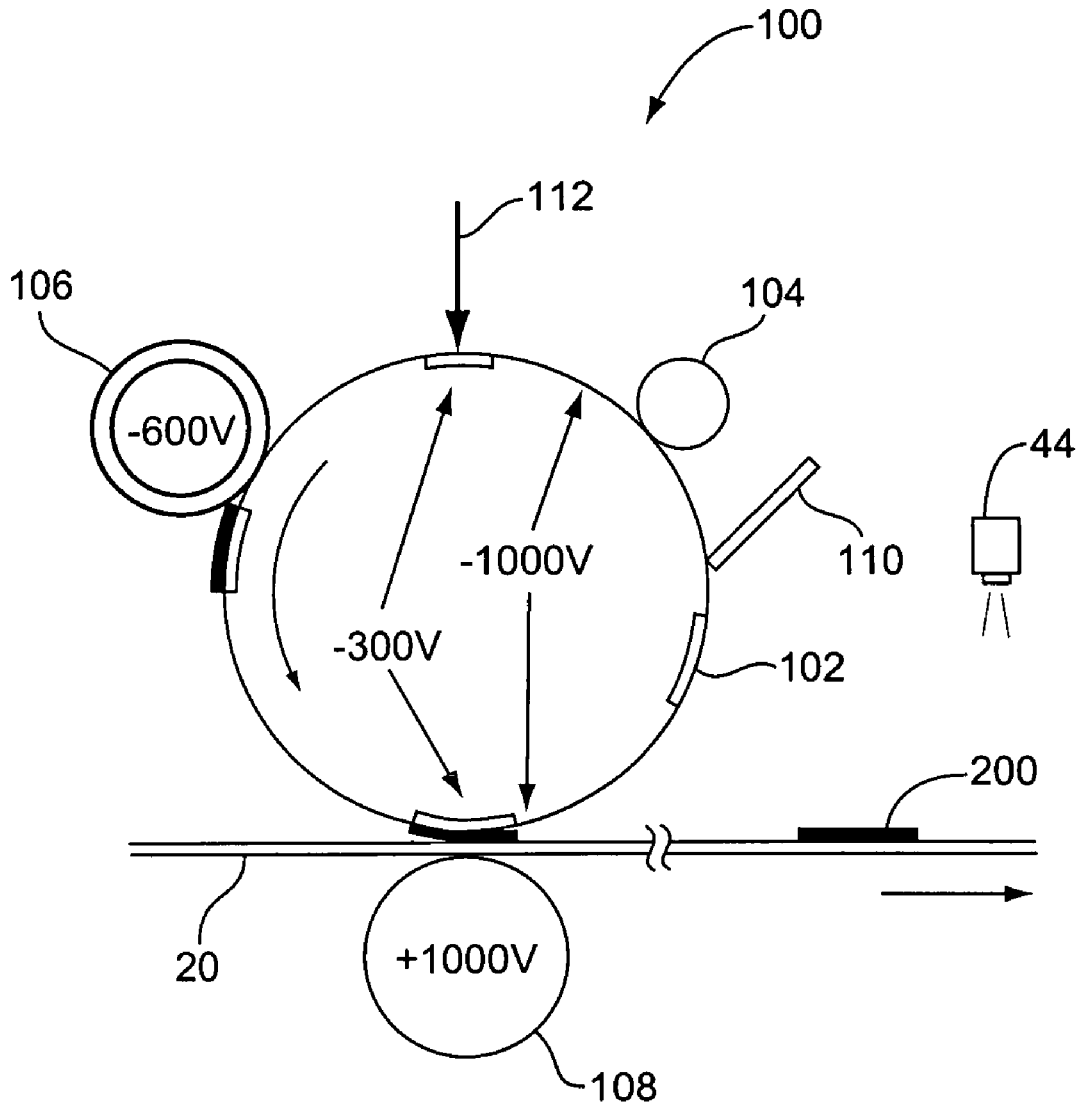
FIG. 2 is a schematic diagram of toner transfer from a photoconductive member to a belt according to one embodiment of the present invention.

FIG. 2 is a schematic diagram illustrating a section of an exemplary image forming station 100. Each image forming station 100 includes a photoconductive (PC) drum 102, a charging unit 104, a developer roll 106, a transfer device 108, and a cleaning blade 110. The charging unit 104 charges the surface of the PC drum 102 to approximately −1000 v. A laser beam 112 originating at the printhead 22 discharges areas on the PC drum 102 to form a latent image on the surface of the PC drum 102. The areas of the PC drum 102 illuminated by the laser beam 112 are discharged to approximately −300 v. The PC drum core is held at −200 v. The developer roll 106 transfers negatively-charged toner having a core voltage of approximately −600 v to the surface of the PC drum 102 to develop the latent image on the PC drum 102. The toner is attracted to the most positive surface, i.e., the area discharged by the laser beam 112.

As the PC drum 102 rotates, a positive voltage field produced by the transfer device 108 attracts and transfers the toner on the PC drum 102 to the media sheet. Alternatively, the toner images could be transferred to an intermediate transfer member (ITM) and subsequently from the ITM to the media sheet. Any remaining toner on the PC drum 102 is then removed by the cleaning blade 110. The transfer device may include a roll, a transfer corona, transfer belt, or multiple transfer devices, such as multiple transfer rolls.

A controller 40 (FIG. 1) controls the operation of the image forming device 10. The functions of the controller 40 include timing control and control of image formation. To perform these functions, the controller 40 receives input from a paper detection sensor 49 and a toner sensor 44. The controller 40 controls the timing of the registration roller 18 and media transport belt 20 based on signals from the paper detection sensor 49 to feed the media sheets with proper timing to the image forming stations 100. The controller 40 uses feedback from the toner sensor 44 to control latent image formation on the PC drums 102 to correct for registration errors.

As illustrated in FIG. 2, the toner patch sensing procedure prints a test toner patch 200 on the media transport belt 20. The toner patch 200 is formed by depositing a solid area patch of black, cyan, magenta, or yellow toner on the belt 20. The device 10 could, alternatively, print the toner patch on an ITM belt, or on the print media. The toner sensor 44 measures the amount of light reflected by the toner patch and generates an output signal that is fed back to the controller 40. The controller 40 takes appropriate corrective action based on the output signal from the toner sensor 44 and adjusts the operating parameters accordingly. Some operating parameters include the laser power, charge on the PC drum 102, and developer bias.

Figure 3:
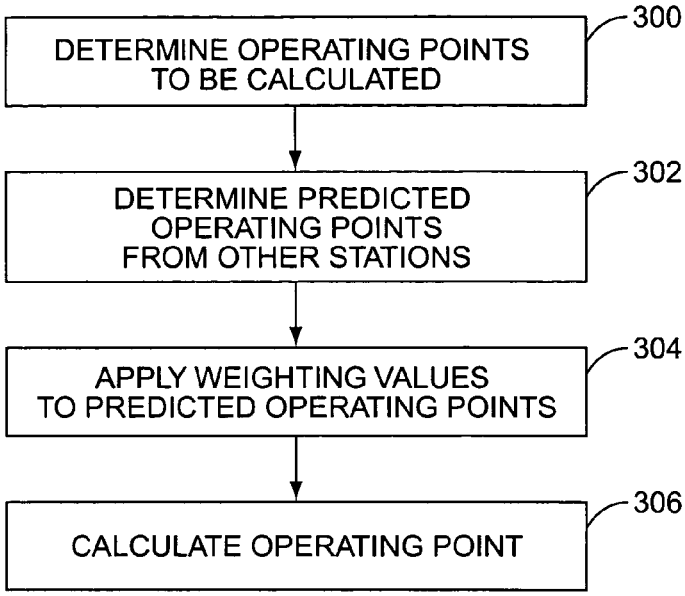
FIG. 3 is a flowchart diagram of a method of determining an operating parameter according to one embodiment of the present invention.

FIG. 3 illustrates the steps of determining the operating parameters according to one embodiment. Initially, a determination is made regarding the operating points that are to be calculated (step 300). This may include the operating points for one or more image forming stations, and may include one or more operating points for each of these image forming stations. By way of example, one embodiment determines one operating point for one image forming station. Another embodiment determines two operating points for each of two separate image forming stations. This example determines a single operating point from two or more other image forming stations.

Next, a predicted operating point is determined from the other image forming stations based on information from the stations (step 302). These predictions may consider the results of toner patch sensing, the age differences between the station at issue and the other stations, and environmental conditions such as temperature and humidity. The environmental conditions may be detected by sensor 41 operatively connected to the controller 40. Once the predicted operating points from the other stations are determined, a weighting factor may be applied to more accurately determine the operating point (step 304). One weighting factor is based on the relative difference in ages between the station at issue and each of the other image forming stations. The closer the ages, the more accurate the predicted operating point. Likewise, the farther apart in age, the less accurate the prediction. Another weighting factor may be the similarity in color between the station at issue and each of the other stations. For example, magenta may provide a more accurate prediction for black than yellow. Finally, the operating point is calculated based on the predicted operating points and the weighting factors (step 306).

Factors from the other image forming stations may include the age of the image forming station, and the toner color. This information may be obtained by the controller 40 through a storage chip 42 mounted on each image forming station 100. When the image forming station 100 is inserted within the main body 12, controller 40 is able to read and update information regarding each image forming station. The factors from the other image forming stations may also include toner patch sensing information that was performed for these image forming stations. Finally, information about the image forming station at issue may also include the age of the image forming station, and the color of toner. This information may be obtained from the storage chip 42 in a similar manner as just described.

In one embodiment, each factor is assigned a value of between 1.0 and 6.5, with 1.0 resulting in formation of a lighter image, and 6.5 resulting in a darker image. The final calculation of the needed operating points results in values within this range. Controller 40 may include memory for correlating the calculated number with the necessary operating point parameter. Alternatively, controller 40 may perform further calculations to obtain the final operating point parameter. The operating point numbers may vary depending upon the specific color. By way of example, a value of 3.5 for the cyan station may be different than the same value for the yellow station.

Figure 4:
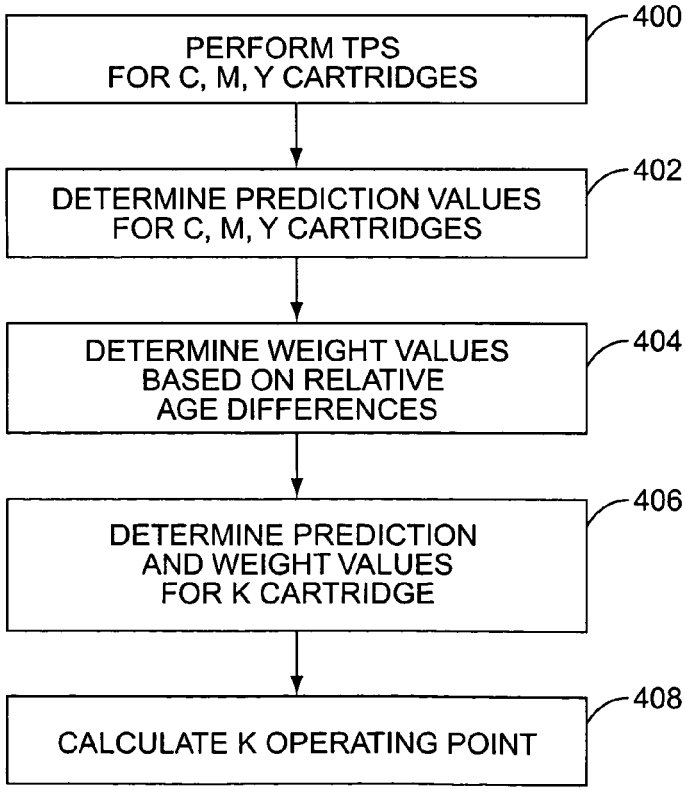
FIG. 4 is a flowchart diagram of a method of determining an operating parameter according to one embodiment of the present invention.

FIG. 4 illustrates another method of determining an operating point. This specific method determines an operating point for the black image forming station. The black operating point may be required from a means other than toner patch sensing because toner patch sensing is not effective due to the shallow slope of the reflection signal versus mass per area. The sensing of black toner is additionally difficult because of the placement on the belt 20 which is also black in color.

Initially, toner patch sensing is performed for the cyan (C), yellow (Y), and magenta (M) image forming stations (step 400). This sensing may occur at the time that the black operating point is to be calculated. Alternatively, the toner patch sensing may have been previously performed and the results for each stored within each corresponding storage chip 42, or within the controller 40. Based on these results, prediction values are determined for each of the C, Y, and M image forming stations (step 402). The following values are determined:

opkc=predicted black operating point based on the cyan toner patch point opkm=predicted black operating point based on the magenta toner patch point opky=predicted black operating point based on the yellow toner patch point These values are based on empirical data and may compensate for typical operating point changes that occur over the life of the stations. These values further include consideration for the relationship between the relative ages between the image forming station and black image forming station.

Next, a weighting factor for each of the C, Y, M image forming stations is determined. In this embodiment, this weighting factor is based on the age differences with the black image forming station (step 404). This step gives weight to values from stations that are closer in age to the black station.

wtc=cyan prediction weight wtn=magenta prediction weight wty=yellow prediction weight Factoring for the black image forming station itself is also included within the calculation (step 406). A predicting black operating point opkk is based on the black component age and the transfer servo voltage. In one embodiment, the predicted black operating point opkk is based on toner patch sensing results for a black image. A black prediction weight wtk is also determined and may be based on a nominal value, or historical information. For the embodiment using toner patch sensing for determining opkk, a lower prediction weight may be applied because of the known inaccuracy in detecting black toner patches.

Finally, a black operating point opkk are determined (step 408).

$$opk=(wtc\times opkc+wtm\times opkm+wty\times opky+wtk\times opkk)/(wtc+wtm+wty+wtk)$$

The factoring of the black image forming station values may be eliminated by setting the values opkk and wtk to zero. This eliminates the effects of the black image forming station. In another embodiment, the black image forming station values may be determined by initially starting with an operating point for a new image forming station at a nominal transfer servo voltage. An empirical operating point shift may be necessary due to the current transfer servo voltage which may be closely related to the environment and particularly the humidity, and a further shift due to the ages of the developer and PC drum.

The values opkc, opky, and opkm, may be shifted depending on other factors. In one embodiment, the values are originally based on the toner patch sensing values. An expected operating point shift may change the value due to aging of the developer and the PC drum. A second operating point shift may be added due to the developer and PC drum age.

An example of the determining the operating point for black is described below. The numerical values in this example are for purposes of explanation to better detail the method. This embodiment assumes that a new station has an operating point of about 1.0. As the stations age, the operating points increase with an old station having an operating point of about 6.0. For this embodiment, assume the cyan and yellow stations are new, and the magenta and black stations are old.

An operating point for cyan obtained through toner patch sensing is determined at 1.0. This is consistent with the above assumption that new stations operate at about 1.0. Factoring in the age differences between the new cyan station and the old black station results in a predicted black operating point opkc based on cyan to be 6.0.

An operating point for yellow is determined through toner patch sensing as 6.0. This is an abnormal reading as the yellow station is new and an expected value would be 1.0. The age factoring between the new yellow station and the old black station results in the predicted black operating point opky to be 13.0.

Next, an operating point for magenta is determined to be 6.0. This is an expected value because the magenta value is old. The age factoring between the old magenta station and the old black station results in the predicted black operating point opkm to be 6.0.

The next step is to apply a weighting factor due to the relative differences between ages with the black station. In this embodiment, a weighting factor of 10% is applied to new stations, and a weighting factor of 80% is applied to old stations. Therefore, the operating point for the black station is calculated as:

$$\text{Black station operating point}=(0.10)(6)+(0.10)(13)+(0.80)(6)$$

This results in the black station operating point to be 6.7.

In one embodiment, a single operating point is determined. This operating point may be for a single device and station parameter (e.g., developer bias), or may be used to set multiple parameters (e.g., developer bias, laser power and charge voltage). In another embodiment, a separate determination is made for each of the different parameters. By way of example, a first determination is made for setting the developer bias, and a second determination is made for setting the laser power. Each of these determinations may include the various steps such as determining prediction values from other stations and applying a weighting value. Alternatively, a first parameter may be determined using a first method, and a second parameter determined using a second method.

U.S. Pat. Nos. 6,463,227 and 6,560,418 each assigned to Lexmark International, Inc., disclose methods for toner patch sensing and adjusting operating parameters. The relevant sections of these patents are herein incorporated by reference.

The age of the imaging forming station may be the amount of toner used or the number of PC drum revolutions. In one embodiment, the age may be determined through a gauging system that tracks an amount of toner remaining within the station. Each station 100 includes one or more agitating members that agitate the toner to prevent clumping, and also move the toner towards the developer roll 106. Agitation of the toner may result in the toner having different properties which require different operating parameters for acceptable image formation. One method of determining the age is a toner gas gauge that tracks a number of discrete steps that occur within the image forming station 100. Each discrete step uses a predetermined amount of toner, therefore, tracking the gas gauge provides for an accurate indication of the amount of remaining toner. This information may also be used for determining the usage of the toner and the necessary operating parameters for forming a toner image. U.S. Pat. No. 5,995,774, assigned to Lexmark International, Inc., discloses methods of determining the amount of toner remaining within a station and the relevant sections are incorporated herein by reference.

In one embodiment, a user may input factors for setting the operating parameters. Information about the media, darkness settings, and resolution typically will be entered by the operators or communicated in data of the print job. In one embodiment, the environmental conditions, including the combined effects of humidity and temperature, can be obtained in a known manner by an automatic observation by the controller 40 of voltage between the PC drum 102 and the transfer device 108. The voltage on the transfer device 108 is increased until a predetermined current is obtained. The final level of that voltage defines the environment.

The components within the image forming stations may operate at a variety of voltages. One embodiment illustrated in FIG. 2 illustrates one set of voltages. Other voltages may also be used and are considered within the scope of this application.

In one embodiment, the predicted operating points are not weighted. The final operating point for the station at issue is determined based on the prediction values.

These methods have application for determining the black operating point based on the operating points from one or more of the other stations. However, the operating points for the other stations may also be determined based on these methods. Further, the operating points for two or more different stations may be obtained using these methods.

The present invention may be carried out in other specific ways than those herein set forth without departing from the scope and essential characteristics of the invention. Various other types of registration sensors 44 may be used for sensing the toner patch. Examples include transmissive optical sensing, capacitive sensing, non-contacting voltage sensing, and others. The present embodiments are, therefore, to be considered in all respects as illustrative and not restrictive, and all changes coming within the meaning and equivalency range of the appended claims are intended to be embraced therein.

What is claimed is:

1. A method of determining an operating point for a first station within an image forming device, the method comprising the steps of:

determining a predicted operating point for the first station based on information from a second station; and determining the operating point for the first station based on the predicted operating point.

2. The method of claim 1, further comprising determining a second predicted operating point for the first station based on information from a third station and determining the operating point based on the first and second predicted operating points.

3. The method of claim 2, further comprising applying weighting values to the predicted operating point and the second predicted operating point based on relative age differences between the first station and the second and third stations.

4. The method of claim 1, wherein the predicted operating point is initially determined based on toner patch sensing from the second station.

5. The method of claim 1, wherein the predicted operating point is initially determined based on ages of the first and second stations.

6. The method of claim 1, wherein the operating point is for a black image forming station.

7. The method of claim 6, further comprising determining operating values for developer bias and laser power based on the operating point.

8. The method of claim 1, further comprising determining the operating point for the first station based on information from the first station.

9. A method of determining an operating point for a first station within an image forming device, the method comprising the steps of:

determining a first predicted operating point for the first station based on a second station operating point;

determining a second predicted operating point for the first station based on a third station operating point; and applying weighting factors to the first and second predicted operating points; and determining the operating point based on weighted first and second predicted operating points.

10. The method of claim 9, wherein the steps of determining the second and third station operating points are based on toner patch sensing from each of the second and third stations.

11. The method of claim 9, wherein the step of calculating the operating point further comprises factoring toner patch sensing information from the first station.

12. The method of claim 9, wherein the steps of determining the second and third station operating points is based on environmental conditions.

13. The method of claim 10, further comprising applying a larger weighting factor to the first predicted operating point than to the second predicted operating point when a relative age difference between the first and second stations is less than the first and third stations.

14. The method of claim 9, further comprising determining a third predicted operating point for the first station based on a third station operating point, applying a weighting factor to the third predicted operating point, and determining the operating point based on a weighted third predicted operating point.

15. A method of determining an operating point for a station within an image forming device, the method comprising the steps of:

performing toner patch sensing for a first station and obtaining a first toner patch value;

performing toner patch sensing for a second station and obtaining a second toner patch value;

determining a first prediction value for the station based on the first toner patch value;

determining a second prediction value for the station based on the second toner patch value;

applying a first weighting factor to the first prediction value;

applying a second weighting factor to the second prediction value; and determining the operating point for the station based on the first and second prediction values.

16. The method of claim 15, wherein the first weighting factor is based on a relative difference in age between the station and the first station.

17. The method of claim 15, wherein the station forms black toner images.

18. The method of claim 15, further comprising applying a greater first weighting factor than a second weighting factor when a relative difference in ages between the station and the first station is less than between the station and the second station.

19. The method of claim 15, wherein the step of determining the operating point for the station comprises applying a factor based on the station.

20. The method of claim 15, further comprising performing toner patch sensing for a third station and obtaining a third toner patch value, determining a third prediction value for the station based on the third toner patch value, applying a third weighting factor to the third prediction value, and determining the operating point for the station based on the third prediction value.

* * * * *